US006513336B2

(12) United States Patent
Zurecki et al.

(10) Patent No.: US 6,513,336 B2
(45) Date of Patent: Feb. 4, 2003

(54) APPARATUS AND METHOD FOR TRANSFERRING A CRYOGENIC FLUID

(75) Inventors: Zbigniew Zurecki, Macungie, PA (US); John Herbert Frey, Allentown, PA (US); Jean-Philippe Trembley, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/911,027

(22) Filed: Jul. 23, 2001

(65) Prior Publication Data

US 2002/0056278 A1 May 16, 2002

Related U.S. Application Data

(63) Continuation-in-part of application No. 09/712,680, filed on Nov. 14, 2000.

(51) Int. Cl.[7] ..... F17C 13/00
(52) U.S. Cl. ..... 62/50.7; 62/51.1; 62/293
(58) Field of Search ..... 62/51.1, 50.7, 62/293

(56) References Cited

U.S. PATENT DOCUMENTS

| | | | | |
|---|---|---|---|---|
| 2,635,399 A | | 4/1953 | West, Jr. | 51/266 |
| 3,433,028 A | * | 3/1969 | Klee | 62/50.7 |
| 3,696,627 A | | 10/1972 | Longswoth | 62/51 |
| 3,706,208 A | * | 12/1972 | Kadi et al. | 62/50.7 |
| 4,296,610 A | | 10/1981 | Davis | 62/55 |
| 4,336,689 A | | 6/1982 | Davis | 62/55 |
| 4,715,187 A | | 12/1987 | Stearns | 62/55 |
| 4,745,760 A | * | 5/1988 | Porter | 62/50.7 |
| 5,009,073 A | * | 4/1991 | Missimer et al. | 62/50.7 |
| 5,103,701 A | | 4/1992 | Lundin et al. | 82/173 |
| 5,477,691 A | | 12/1995 | White | 62/50 |
| 5,509,335 A | | 4/1996 | Emerson | 82/1.11 |
| 5,520,682 A | * | 5/1996 | Baust et al. | 62/293 |
| 5,592,863 A | | 1/1997 | Jaskowiak et al. | 82/1.11 |
| 5,761,974 A | | 6/1998 | Wang et al. | 82/1.11 |
| 5,901,623 A | | 5/1999 | Hong | 82/50 |

FOREIGN PATENT DOCUMENTS

| | | | |
|---|---|---|---|
| JP | 6210105 | 8/1994 | B01D/19/00 |

OTHER PUBLICATIONS

Biomedical Instrumentation and Tech., "Development of a High–Performance Multiprobe Cryosurgical Device", Chang, et al, 1994.

* cited by examiner

*Primary Examiner*—Ronald Capossela
(74) *Attorney, Agent, or Firm*—Robert J. Wolff

(57) ABSTRACT

A method and apparatus are set forth for transferring a cryogenic fluid. A polymeric, coaxial (i.e. "tube-in-tube" geometry) transfer line is utilized where a first portion of the cryogenic fluid flows through the inner tube while a second portion flows through an annulus between the inner tube and outer tube which annulus is at a lower pressure than the inside tube. In one embodiment, the inner tube is substantially non-porous and the transfer line is preceded by a flow control means to distribute at least part of the first and second portions of the cryogenic fluid to the inner tube and annulus respectively. In a second embodiment, the inner tube is porous with respect to both gas permeation and liquid permeation such that both a gaseous part and a liquid part of the first portion permeates into the annulus to form at least a part of the second portion.

26 Claims, 1 Drawing Sheet

APPARATUS AND METHOD FOR TRANSFERRING A CRYOGENIC FLUID

CROSS-REFERENCE TO RELATED APPLICATIONS

This Application is a Continuation-in-Part of U.S. patent application Ser. No. 09/712,680 which was filed on Nov. 14, 2000.

STATEMENT REGARDING FEDERALLY SPONSORED RESEARCH OR DEVELOPMENT

Not applicable.

BACKGROUND OF THE INVENTION

In many cryogenic fluid transfer applications, it is important that the fluid be transferred in a 100% liquid state, or as close to 100% as possible. Conventionally, this required the fluid to be initially phase-separated and/or subcooled in a heat exchanger and/or vacuum jacketing the line to keep it well insulated. Otherwise, the heat leak in the transfer line would cause boil-off, thereby causing flow undulations in the transfer line and resulting in a non-steady, pulsing and generally undesirable flow. Heat leak is particularly a problem for long transfer lines.

The present invention addresses this first concern for cryogenic transfer lines with a coaxial or "tube-in-tube" geometry where a first portion of the cryogenic fluid flows through the inner tube while a second portion flows through an annulus between the inner tube and outer tube which annulus is at a lower pressure than the inside tube. By virtue of this pressure differential, one skilled in the art can appreciate that the liquid in the annulus can provide a refrigeration duty to the liquid inside the inner tube (e.g. such as by boiling) such that this inner liquid is cooled and stays a saturated liquid. Preferably, the liquid is even subcooled slightly such that a "cushion" of refrigeration is available to fight heat leak.

It is also important in many cryogenic fluid transfer applications that the transfer line be lightweight and flexible. This provides for maximum degrees of freedom during installation, operation and maintenance and also enables the line to withstand repeated bending. The present invention addresses this second concern for cryogenic transfer lines by making at least a portion of the line out of a flexible polymeric material.

The prior art does not provide for a cryogenic fluid transfer line that addresses both of these important concerns.

U.S. Pat. No. 3,696,627 (Longsworth) teaches a liquid cryogen transfer system having a rigid coaxial piping arrangement for subcooling and stabilizing cryogen flow during transfer. U.S. Pat. No. 4,296,610 (Davis), U.S. Pat. No. 4,336,689 (Davis), U.S. Pat. No. 4,715,187 (Stearns) and U.S. Pat. No. 5,477,691 (White) teach similar systems.

Chang et al. teaches non-metallic, flexible cryogenic transfer lines for use in cryosurgical systems where the cryogen is used to cool the cryoprobe in a cryosurgical system ("Development of a High-Performance Multiprobe Cryosurgical Device", Biomedical Instrumentation and Technology, September/October 1994, pp. 383–390). Due to the heat leak boil-off resulting from the design of the flexible lines in Chang, combined with intrinsically poor insulation, such lines must be short and fed with a substantially subcooled cryogenic liquid (e.g. liquid nitrogen at −214° C.) in order to work properly. This requires the up-stream usage of complex and expensive cryogenic storage, supply and control systems.

Cryogenic transfer lines are also taught for use in machining applications where the cryogen is used to cool the interface of the cutting tool and the workpiece. See for example U.S. Pat. No. 2,635,399 (West), U.S. Pat. No. 5,103,701 (Lundin), U.S. Pat. No. 5,509,335 (Emerson), U.S. Pat. No. 5,592,863 (Jaskowiak), U.S. Pat. No. 5,761,974 (Wagner) and U.S. Pat. No. 5,901,623 (Hong). Similar to Chang, such lines must be short and fed with a substantially subcooled cryogenic liquid to combat heat leak boil-off and thus requires an expensive up-stream subcooling system.

U.S. Pat. No. 3,433,028 (Klee) discloses a coaxial system for conveying cryogenic fluids over substantial distances in pure single phase. Using fixed-size, inlet orifices in the cryogenic-conveying inner line, the liquid is admitted to the outer line where it vaporizes when subject to an external heat leak. A thermal sensor-based flow control unit, mounted at the exit end of this coaxial line, chokes the flow of the vapor in the outer line depending on the value of temperature required, usually 50 to 100 deg. F. more than the boiling point of the liquid in the inner line. As a result, the outer line pressure may be near the cryogenic source pressure, and its vapor always will be warmer than the inner line liquid. Moreover, high heat leaks cannot be fully countered since the amount of liquid admitted to the outer line for evaporation is permanently limited by the fixed-size inlet orifices. These operating principles necessitate the use of high-pressure resistant, non-flexing metal tubes and a thick-wall thermal insulation in the construction of the line.

JP 06210105 A teaches a polymeric coaxial transfer line for non-cryogenic degassing applications. The tube material characteristics preclude the use of the transfer line in cryogenic applications.

BRIEF SUMMARY OF THE INVENTION

The present invention is a method and apparatus for transferring a cryogenic fluid. A polymeric, coaxial (i.e. "tube-in-tube" geometry) transfer line is utilized where a first portion of the cryogenic fluid flows through the inner tube while a second portion flows through an annulus between the inner tube and outer tube which annulus is at a lower pressure than the inside tube. In one embodiment, the inner tube is substantially non-porous and the transfer line is preceded by a flow control means to distribute at least part of the first and second portions of the cryogenic fluid to the inner tube and annulus respectively. In a second embodiment, a least a portion of the inner tube is porous with respect to both gas permeation and liquid permeation such that both a gaseous part and a liquid part of the first portion permeates into the annulus to form at least a part of the second portion.

DETAILED DESCRIPTION OF THE INVENTION

Figure 1:
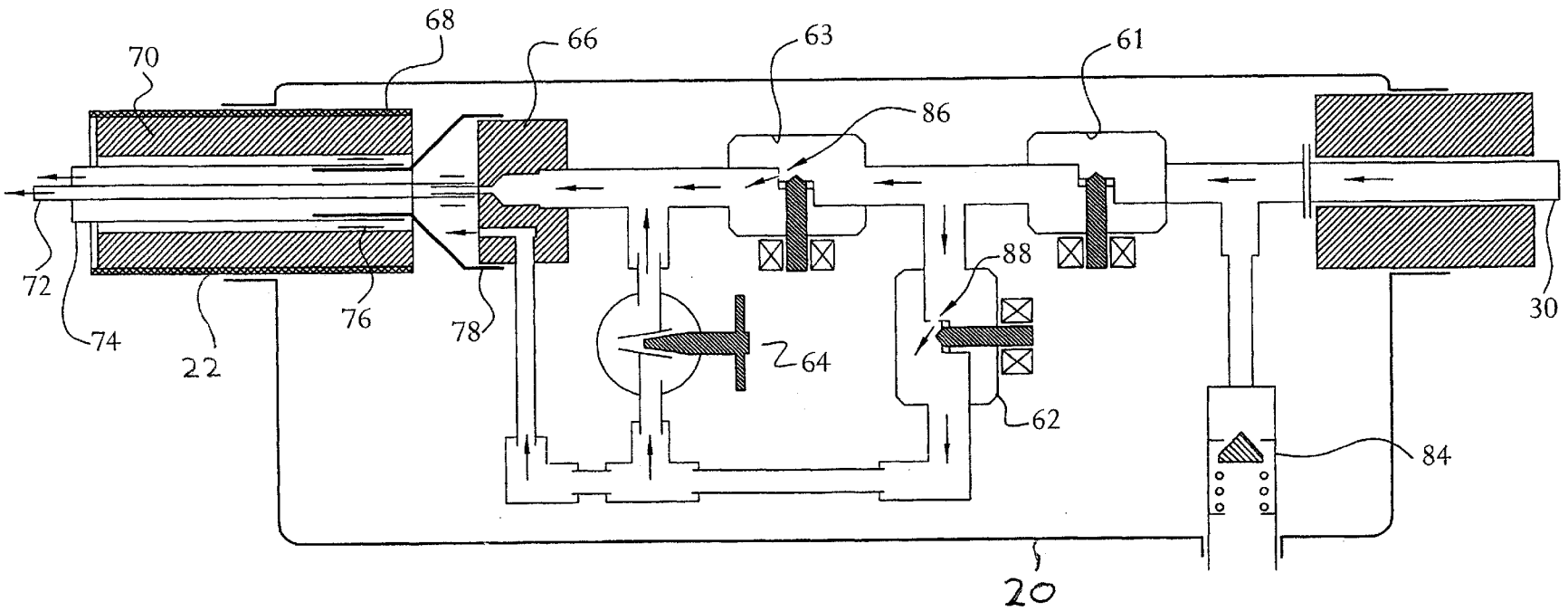
FIG. 1 is a schematic drawing of one embodiment of the present invention.

The present invention's polymeric, coaxial transfer line is best illustrated with respect to a general embodiment thereof such as FIG. 1's embodiment where the transfer line 22 is preceded by a flow control box 20. Transfer line 22 comprises an inner tube 72 surrounded by an outer tube 74 surrounded by insulation 70 surrounded by flexible protective casing 68. A first portion of the cryogenic fluid flows through the inner tube while a second portion flows through the annulus between the inner tube and outer tube. The first portion is at a higher pressure than the second portion.

At least a portion of the transfer line is made of a flexible, polymeric material. In one possible embodiment, substantially all of the inner tube and substantially all of the outer tube are made of a flexible, polymeric material. In another possible embodiment, substantially all of the outer tube can be made of a flexible polymeric material while substantially all of the inner tube can be made of a flexible non-polymeric material that do not become brittle at cryogenic temperatures such as (i) copper and its alloys, (ii) aluminum and its alloys, (iii) nickel and its alloys, (iv) austenitic stainless steels, (v) dense graphite or (vi) ceramic fiber textile-woven tubing products.

The inner tube can be substantially non-porous such that little, if any, of the second portion of the fluid in the annulus is a result of permeation through the inner tube. Or, at least a portion of the inner tube can be porous with respect to both gas permeation and liquid permeation such that both a gaseous part and a liquid part of the first portion permeates into the annulus to form at least a part of the second portion. Or, certain sections of the inner tube, perhaps spaced equally along the length of the inner tube, could be of enhanced porosity.

The transfer line is advantageously preceded by a flow control means to distribute at least part of the first and second portions of the cryogenic fluid to the inner tube and annulus respectively such as flow control box 20 in FIG. 1. The flow control means would also typically integrate the means (e.g. valve) to reduce the pressure of the second portion of fluid that is distributed to the annulus, at least a fraction of which second portion of fluid is distributed into the annulus as a liquid. By virtue of this pressure differential, the liquid in the annulus can provide a refrigeration duty to the fluid inside the inner tube. In the case of an at least partially porous inner tube, the permeation from the inner tube into the annulus gas can supplement at least a portion of the fluid distribution performed by the flow control box. The connections and internal components of the flow control box include three on/off (e.g. solenoid) valves (61, 62, 63) and a manual metering valve 64, which valves are in fluid communication with the inlet 30 to the flow control box and adapted to receive and pressure regulate a flow of the cryogenic fluid. A key internal component of flow control box 20 is 3-way coupling 66 which introduces the first and second portions of the cryogenic fluid to the inner tube and annulus respectively. Thread connection 78 connects the 3-way coupling 66 to the outer tube 74. An optional line clamp 76 may be used to clamp the outer tube to the thread connection. Flow control box 20 has an insulated casing and optionally contains insulating filler. Pressure relief valve 84 is optional. On/off valves 62 and 63 have an internal bypass orifice (86, 88) drilled in their internal wall or valve seat.

At least a fraction of the second portion of fluid in the annulus can be transferred to the transfer destination and/or cooling target along with the liquid stream in the inner tube. Optionally, at least a fraction of the second portion of fluid in the annulus can be vented away from the transfer destination/cooling target. In the former case, this can be accomplished via the use of a coaxial nozzle having an inner conduit in fluid communication with the inner tube of the transfer line and an outer conduit in fluid communication with the annulus of the transfer line. In the latter case where all of the annulus fluid is vented, this would remove the constraint that the flow direction in the annulus be concurrent with the flow direction in the inner tube. Preferably, any nozzle should include thermal shrink connectors to prevent leaks between the interface of the transfer line and nozzle.

Examples of suitable polymeric materials for the present invention's transfer line include carbon-flourine based polymers, co-polymers and composites thereof such as Teflon™ products. (Teflon™ is a registered trademark of E.I. DuPont de Nemours and Company).

Examples of cryogenic fluids that can be transferred by the present invention's transfer line include nitrogen, argon or mixtures thereof.

The present invention's apparatus and method for transferring a cryogenic fluid is particularly suitable for transfer locations and/or cooling targets that require a relatively low flow rate and a rapid liquid response. Examples of such transfer destinations and/or cooling targets for the present invention's transfer line include:

(i) an environmental test chamber used for stress screening electronic components;

(ii) a component to be shrink fitted;

(iii) a specimen holding container used in for biological storage;

(iv) a nitrogen droplet dispenser;

(v) a cutting tool and/or workpiece in a machining application; and (vi) a cryoprobe in a cryosurgical system.

What is claimed is:

1. A transfer line for transferring a cryogenic fluid comprising an inner tube surrounded by an outer tube wherein:

(a) a first portion of the cryogenic fluid flows through the inner tube while a second portion flows through an annulus between the inner tube and outer tube;

(b) the first portion is at a higher pressure than the second portion by virtue of a means which maintains the pressure in the inner tube higher than the annulus;

(c) at least a portion of the transfer line is made of a flexible, polymeric material; and (d) at least a fraction of the second portion of fluid inside the annulus is liquid that provides a refrigeration duty to the first portion of fluid inside the inner tube.

2. The transfer line of claim 1 wherein the inner tube is substantially non-porous.

3. The transfer line of claim 1 wherein at least a portion of the inner tube is porous with respect to both gas permeation and liquid permeation such that both a gaseous part and a liquid part of the first portion permeates into the annulus to form at least a part of the second portion.

4. The transfer line of claim 3 wherein certain sections of the inner tube along the length of the inner tube are of enhanced porosity.

5. The transfer line of claim 1 wherein the transfer line is preceded by a flow control means to distribute at least part of the first and second portions of the cryogenic fluid to the inner tube and annulus respectively.

6. The transfer line of claim 5 wherein the flow control means is a flow control box comprising:

(i) an inlet adapted to receive the cryogenic fluid;

(ii) a plurality of valves in fluid communication with the inlet and adapted to receive and pressure regulate a flow of the cryogenic fluid wherein at least one of the valves is an on/off valve and at least one of the valves is a metering valve; and (iii) a three-way coupling having a first end in fluid communication with at least one of the valves and a second end in fluid communication with the transfer line.

7. The transfer line of claim 1 wherein at least a fraction of the second portion of fluid in the annulus is transferred to the transfer destination and/or cooling target along with the liquid stream in the inner tube via the use of a coaxial nozzle having an inner conduit in fluid communication with the inner tube of the transfer line and an outer conduit in fluid communication with the annulus of the transfer line.

8. The transfer line of claim 1 wherein at least a fraction of the second portion is vented from the annulus away from the transfer destination and/or cooling target.

9. The transfer line of claim 1 wherein the polymeric material is selected from the group consisting of carbon-flourine based polymers, co-polymers and composites thereof.

10. The transfer line of claim 1 wherein the cryogenic fluid is selected from the group consisting of nitrogen, argon or mixtures thereof.

11. The transfer line of claim 1 wherein the transfer line is used to deliver at least a portion of the cryogenic fluid to a transfer destination and/or cooling target selected from the group consisting of:

(i) an environmental test chamber used for stress screening electronic components;

(ii) a component to be shrink fitted;

(iii) a specimen holding container used in for biological storage;

(iv) a nitrogen droplet dispenser;

(v) a cutting tool and/or workpiece in a machining application; and (vi) a cryoprobe in a cryosurgical system.

12. The transfer line of claim 1 wherein substantially all of the inner tube and substantially all of the outer tube are made of a flexible, polymeric material.

13. The transfer line of claim 1 wherein substantially all of the outer tube is made of a flexible polymeric material while substantially all of the inner tube is made of a flexible non-polymeric material selected from the group consisting of (i) copper and its alloys, (ii) aluminum and its alloys, (iii) nickel and its alloys, (iv) austenitic stainless steels, (v) dense graphite or (vi) ceramic fiber textile-woven tubing products.

14. A method for transferring a cryogenic fluid utilizing a transfer line comprising an inner tube surrounded by an outer tube, said process comprising flowing a first portion of the cryogenic fluid flows through the inner tube while flowing a second portion through an annulus between the inner tube and the outer tube wherein (a) the first portion is at a higher pressure than the second portion by virtue of a means which maintains the pressure in the inner tube higher than the annulus;

(b) at least a portion of the transfer line is made of a flexible, polymeric material; and (c) at least a fraction of the second portion of fluid inside the annulus is liquid that provides a refrigeration duty to the first portion of fluid inside the inner tube.

15. The method of claim 14 wherein the inner tube is substantially non-porous.

16. The method of claim 14 wherein at least a portion of the inner tube is porous with respect to both gas permeation and liquid permeation such that both a gaseous part and a liquid part of the first portion permeates from the inner tube into the annulus to form at least a part of the second portion.

17. The method of claim 16 wherein certain sections of the inner tube along the length of the inner tube are of enhanced porosity.

18. The method of claim 14 wherein the transfer line is preceded by a flow control means to distribute at least part of the first and second portions of the cryogenic fluid to the inner tube and annulus respectively.

19. The method of claim 18 wherein the flow control means is a flow control box comprising:

(i) an inlet adapted to receive the cryogenic fluid;

(ii) a plurality of valves in fluid communication with the inlet and adapted to receive and pressure regulate a flow of the cryogenic fluid wherein at least one of the valves is an on/off valve and at least one of the valves is a metering valve; and (iii) a three-way coupling having a first end in fluid communication with at least one of the valves and a second end in fluid communication with the transfer line.

20. The method of claim 14 wherein at least a fraction of the second portion of fluid in the annulus is transferred to the transfer destination and/or cooling target along with the liquid stream in the inner tube via the use of a coaxial nozzle having an inner conduit in fluid communication with the inner tube of the transfer line and an outer conduit in fluid communication with the annulus of the transfer line.

21. The method of claim 14 wherein at least a fraction of the second portion is vented from the annulus away from the transfer destination and/or cooling target.

22. The method of claim 14 wherein the polymeric material is selected from the group consisting of carbon-flourine based polymers, co-polymers and composites thereof.

23. The method of claim 14 wherein the cryogenic fluid is selected from the group consisting of nitrogen, argon or mixtures thereof.

24. The method of claim 14 wherein the transfer line is used to deliver at least a portion of the cryogenic fluid to a transfer destination and/or cooling target selected from the group consisting of:

(i) an environmental test chamber used for stress screening electronic components;

(ii) a component to be shrink fitted;

(iii) a specimen holding container used in for biological storage;

(iv) a nitrogen droplet dispenser;

(v) a cutting tool and/or a workpiece in a machining application; and (vi) a cryoprobe in a cryosurgical system.

25. The method of claim 14 wherein substantially all of the inner tube and substantially all of the outer tube are made of a flexible, polymeric material.

26. The method of claim 14 wherein substantially all of the outer tube is made of a flexible polymeric material while substantially all of the inner tube is made of a flexible non-polymeric material selected from the group consisting of (i) copper and its alloys, (ii) aluminum and its alloys, (iii) nickel and its alloys, (iv) austenitic stainless steels, (v) dense graphite or (vi) ceramic fiber textile-woven tubing products.

* * * * *